US006005520A

United States Patent [19]

Nalbandian et al.

[11] Patent Number: 6,005,520

[45] Date of Patent: Dec. 21, 1999

[54] WIDEBAND PLANAR LEAKY-WAVE MICROSTRIP ANTENNA

[75] Inventors: Vahakn Nalbandian, Ocean, N.J.; Choon Sae Lee, Dallas, Tex.

[73] Assignee: The United States of America as represented by the Secretary of the Army, Washington, D.C.

[21] Appl. No.: 09/050,149

[22] Filed: Mar. 30, 1998

[51] Int. Cl.[6] ..... H01Q 1/38

[52] U.S. Cl. ..... 343/700 MS; 343/829; 343/846

[58] Field of Search ..... 343/700 MS, 829, 343/846; H01Q 1/38

[56] References Cited

U.S. PATENT DOCUMENTS

| | | | |
|---|---|---|---|
| 4,980,693 | 12/1990 | Wong et al. | 343/700 MS |
| 5,561,435 | 10/1996 | Nalbandian et al. | 343/700 MS |

OTHER PUBLICATIONS

U.S. application No. 09/040,006, Nalbandian et al., filed Mar. 17, 1998.

*Primary Examiner*—Don Wong

*Assistant Examiner*—Hoang Nguyen

*Attorney, Agent, or Firm*—Michael Zelenka; George B. Tereschuk

[57] ABSTRACT

A wideband leaky-wave microstrip antenna having two elongated rectangular conductive patches separated by a gap on a first dielectric material and an elongated rectangular conductive coupling patch on a second dielectric material placed over the gap. The selective placement of the conductive patches and the gap formed thereby permits impedance matching resulting in a leaky-wave propagation mode. Non-radiating modes of propagation are not excited, thereby enhancing the leaky-wave mode of propagation causing radiation. This results in a relatively wide bandwidth of operation that has a main beam that is scannable as a function of frequency. The bandwidth increases substantially as the dielectric constant approaches one. The planar construction contributes to design flexibility and ease of manufacture and has many applications military and commercial communication systems.

8 Claims, 4 Drawing Sheets

WIDEBAND PLANAR LEAKY-WAVE MICROSTRIP ANTENNA

STATEMENT OF GOVERNMENT RIGHTS

The invention described herein may be manufactured, used and licensed by or for the Government for governmental purposes without the payment to us of any royalty thereon.

FIELD OF THE INVENTION

This invention relates in general to microstrip antennas, and particularly to wide bandwidth, variable impedance, leaky-wave transmission mode antennas.

BACKGROUND OF THE INVENTION

Microstrip antennas are used in many applications and have advantageous features such as being lightweight, having a low profile, being planar, and generally of relatively low cost to manufacture. Additionally, the planar structure of a microstrip antenna permits the microstrip antenna to be conformed to a variety of surfaces having different shapes. This results in the microstrip antenna being applicable to many military and commercial devices, such as use on aircraft or space antennas. However, the application of many microstrip antennas are limited due to their inherent narrow, less than 10%, frequency bandwidth. While there have been attempts to increase this bandwidth, they have had limited success. Additionally, previous wideband antennas have been bulky and relatively complex such as horn, helix, or log periodic antennas. Therefore, there is a need for a wide bandwidth antenna that combines the benefits of a microstrip antenna with the wideband features of relatively more costly and complex antennas.

SUMMARY OF THE INVENTION

The present invention is a microstrip antenna having an input impedance matched to a particular leaky-wave transmission mode. This is accomplished by altering the distribution at the feed location to match the input impedance to a particular leaky-wave transmission mode and suppression of surface-mode excitations. The wideband leaky-wave microstrip antenna comprises a lower planar dielectric layer having a conductive ground plane on one planar surface and a first and second conductive patch separated by a gap on the opposing planar surface. A coaxial probe is coupled to one of the conductive patches. An upper planar dielectric layer is placed over the gap and over the conductive patches. A conductive coupling patch is placed on the upper planar dielectric layer positioned over the gap and partially over the first and second patches. By varying the locations and widths of the conductive patches, the input impedance may be varied and selected to suppress non-radiating surface modes.

Accordingly, it is an object of the present invention to provide a wideband microstrip antenna that is easily manufactured.

It is an advantage of the present invention that the input impedance may be varied.

It is a further advantage of the present invention that a relatively wide bandwidth is obtained in a microstrip structure.

It is a feature of the present invention that a double layer of dielectric material and conductive patches are used.

It is a further feature of the present invention that it operates in a frequency range permitting leaky-mode operation.

It is a further feature of the present invention that the bandwidth increases as the dielectric constant decreases.

It is a further feature of the present invention that the main beam may be scanned as a function of frequency.

These and other objects, advantages, and features will be readily apparent in view of the following detailed description.

DETAILED DESCRIPTION OF THE PREFERRED EMBODIMENT

Figure 1:
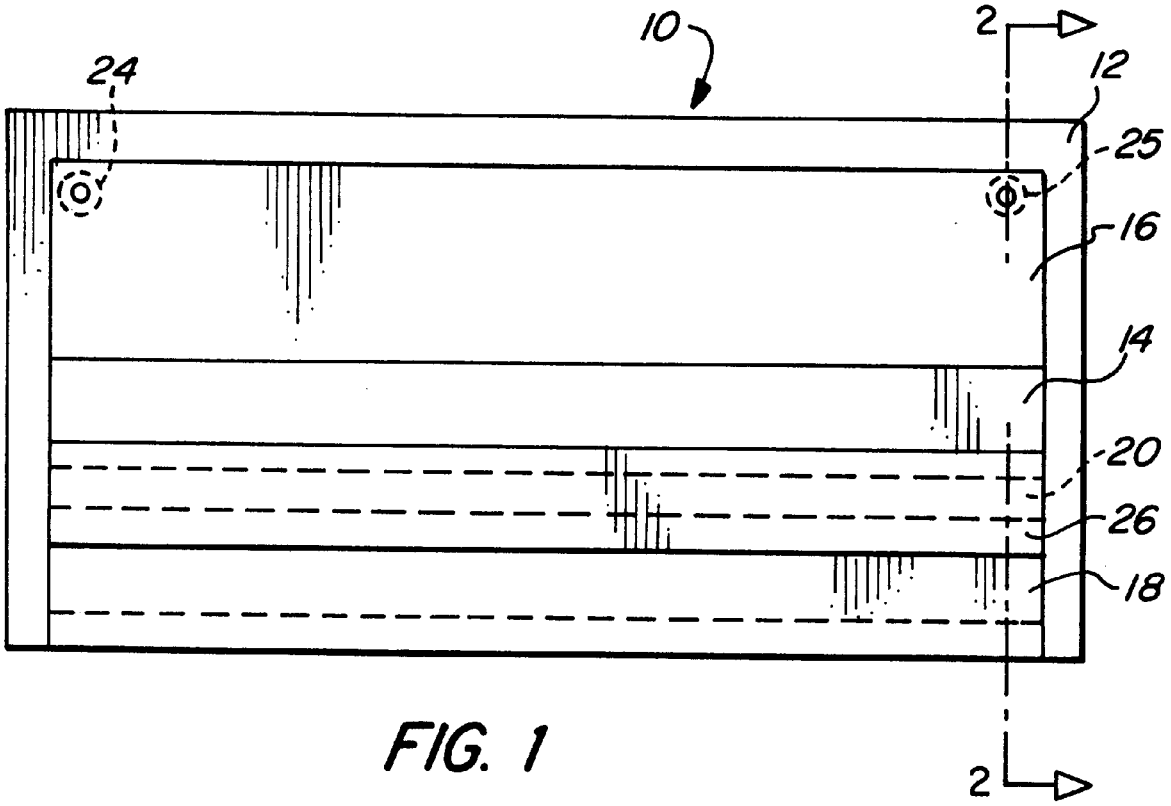
FIG. 1 is a plan view of one embodiment of the present invention.

FIG. 1 illustrates the wideband leaky-wave microstrip antenna 10 of the present invention. The leaky-wave microstrip antenna 10 has a lower rectangular dielectric layer 12 and upper rectangular dielectric layer 14. Placed on the lower layer 12 is a first rectangular conductive patch 16 and a second rectangular conductive patch 18. A gap 20 separates the first patch 16 and the second patch 18. A conductive coupling patch 26 is placed on the upper layer 14 positioned over the gap 20. The coupling patch 26 covers a portion or is placed over a portion of the first patch 16 and the second patch 18. The coupling patch 26 covers the entire width of the gap 20. A coaxial probe 24, which may be an SMA connector, is coupled to the first rectangular conductive patch 16 at one corner opposite the gap 20. Coaxial probe 24 provides electromagnetic energy, preferably in a microwave frequency range, to the leaky-wave antenna 10. The coaxial probe 24 is positioned at the longitudinal end of the conductive patch 16. The coaxial feed has an impedance of fifty ohms. A second coaxial probe 25 may be positioned at an opposing corner to obtain experimental data relating to the propagation and radiating properties of the antenna. The leaky-wave antenna 10 has a longitudinal length substantially longer than the lateral width. The length is at least twice as long as the width.

Figure 2:
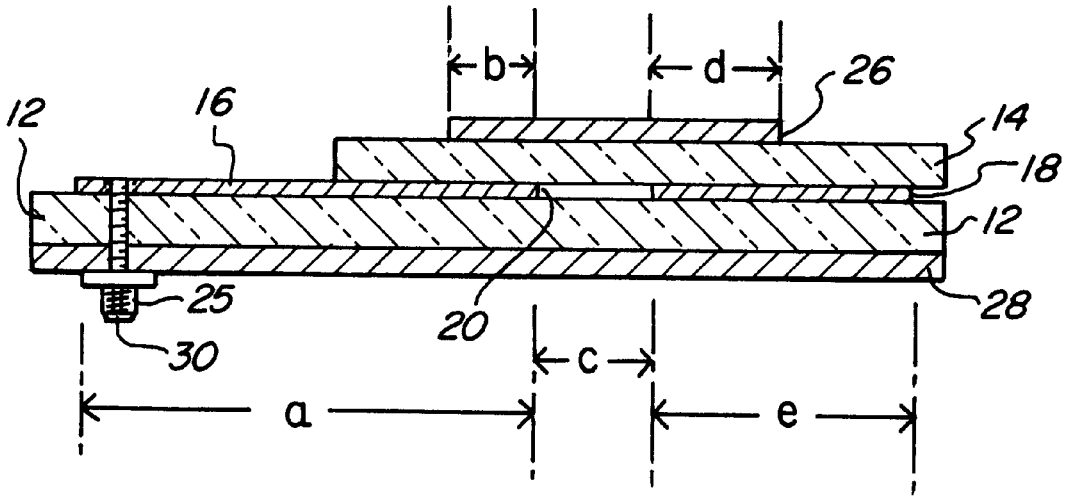
FIG. 2 is a cross section taken along line 2—2 in FIG. 1.

FIG. 2 is a cross section taken along line 2—2 in FIG. 1. FIG. 2 more clearly illustrates the structure of the present invention. The lower layer 12 is a dielectric material that may be made of Duroid dielectric material having a dielectric constant of approximately 2.2. However, other dielectric materials may be used, for example, ROHACELL 71 HF dielectric material having a dielectric constant of approximately 1.1. The lower the dielectric constant is, the wider the bandwidth becomes. The lower layer 12 may have a generally rectangular shape. Placed on the planar surface of the lower dielectric 12 is a conductive ground plane 28. The ground plane 28 may be made of any conductive material, such as silver or copper. The first patch 16 and the second patch 18 are formed of a conductive material, such as copper or silver, and are formed on the opposing planar surface of the lower layer 12. The first and second patches 16 and 18 may be formed on the lower layer 12 by any conventional means, such as deposition or etching, or may be attached with adhesive. The first and second patches 16 and 18 are illustrated having a generally rectangular shape, but due to the flexibility of the microstrip structure, various geometrical shapes are possible. The different shapes may be utilized to modify the antenna radiation patterns. However, in order to efficiently radiate in the leaky-wave transmission mode, the longitudinal length should be relatively long. This permits more energy to be radiated while the electromagnetic radiation travels longitudinally along the length of the antenna. Additionally, the longitudinal length of the leaky-wave antenna 10 should increase as the thickness decreases in order to compensate reduced radiation power in a unit longitudinal length. The first and second patches 16 and 18 are positioned so that a gap 20 is formed there between. An upper dielectric layer 14 is positioned partly on top of the first patch 16 and the second patch 18, bridging the gap 20. An upper coupling patch 26, which may be made of any conductive material, such as copper or silver, is placed on the opposing planar surface of upper dielectric surface 14. The coupling patch 26 is positioned over the gap 20 and covers a portion of the first patch 16 and the second patch 18. The coaxial probes 24 and 25 have a conductor 30 coupled to the first patch 16 and the lower dielectric layer 12. Only one coaxial probe is needed as a source. The other coaxial probe may be used for obtaining other experimental data. The present invention is similar to a prior invention by the same inventors entitled "Impedance Matching of A Double Layer Microstrip Antenna By A Microstrip Line Feed" presently designated as CECOM Docket #5296, which is herein incorporated by reference. That application was filed in the United States Patent and Trademark Office on Mar. 17, 1998, and given Ser. No. 09/040,006. This prior invention, while structurally similar, has a completely different mode of operation with a very narrow bandwith.

Referring to FIGS. 1 and 2, distance a represents the lateral distance of first patch 16. Distance b represents the lateral distance over which coupling patch 26 overlaps first patch 16. Distance c represents the lateral distance of gap 20 between the first patch 16 and the second patch 18. Distance d illustrates the lateral distance overlapping portion of coupling patch 26 with second patch 18. Distance e represents the lateral distance of second patch 18.

Figure 3:
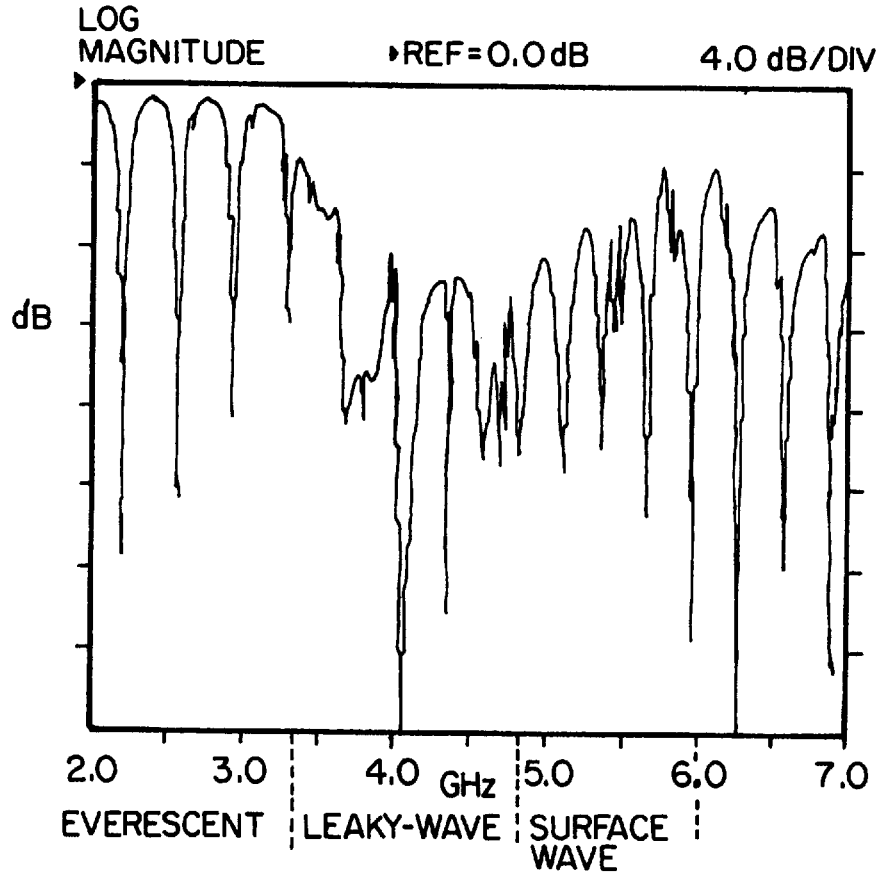
FIG. 3 is a graph illustrating the return loss as a function of frequency.

FIG. 3 is a graph illustrating the return loss as a function of frequency for a particular embodiment of the present invention. The X axis represents frequency in GHz and the Y axis represents magnitude in decibels. The X axis may be divided up into three regions representative of the propagation mode of the electromagnetic radiation. The evanescent region, the leaky-wave region, and the surface wave region. As the frequency increases further, a higher-order leaky mode may be excited. However, this mode usually radiates in an undesirable way. FIG. 3 represents the data from a first embodiment of the present invention that has been tested. In this first embodiment, a dielectric material, DUROID, having a dielectric constant of 2.2 was used. Additionally, the thickness of both the upper and lower layers of dielectric material was 62 mils or approximately 1.57 millimeters. Referring to FIG. 2, distance a was 2.4 centimeters, distance b was 0.4 centimeters, distance c was 0.3 centimeters, distance d was 0.4 centimeters, and distance e was 0.6 centimeters. Copper foil was used for the conductive patches and had a thickness of 0.7 mils or approximately 0.02 millimeters. The longitudinal length of the dielectric material was 30 centimeters and the longitudinal length of the copper foil was 28 centimeters. Accordingly, in this first embodiment the longitudinal length was substantially greater than the lateral width. The longitudinal length was greater than approximately eight times the lateral width. The double layer leaky-wave microstrip antenna was thermally bonded by using 1.5 mil or approximately 0.04 millimeters thick bonding film. The RF feed location was optimized along the direction perpendicular to the direction of propagation. The frequency range of the lowest order of leaky-mode propagation is measured from the values at which the transmission is small because most of the transmitted power is due to the surface mode propagation. The measured frequency band ratio is 1:1.35 and the experimental cut-off frequency is 3.4 GHz. This is consistent with the theoretical values of 1:1.354 and 3.71 GHz. Fabrication error and the edge effects in the cavity model may have contributed to the discrepancy between the theory and the experimental results.

Figure 4:
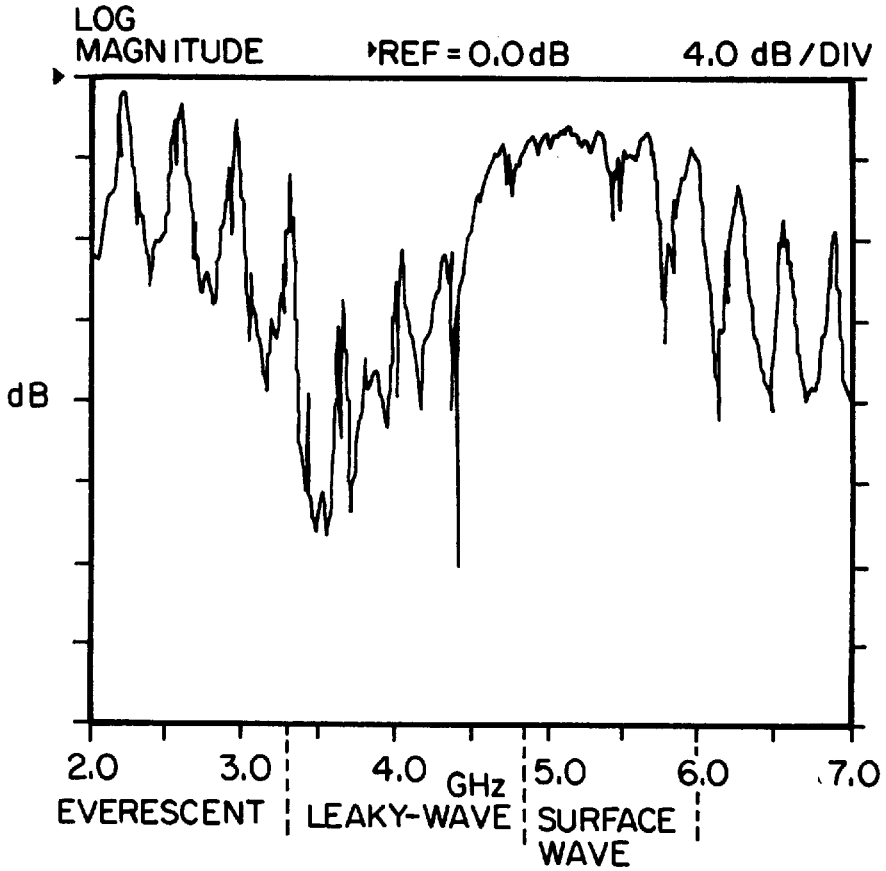
FIG. 4 is a graph illustrating the transmission loss as a function of frequency.

FIG. 4 is a graph illustrating the transmission loss as a function of frequency for the first embodiment described above. Similar to FIG. 3, the graph in FIG. 4 may be divided up into several regions, the evanescent region, the leaky-wave region and the surface wave region. From FIGS. 3 and 4 it should be appreciated that the first embodiment demonstrates the principal of a leaky-wave propagation mode in a microstrip structure.

Figure 5:
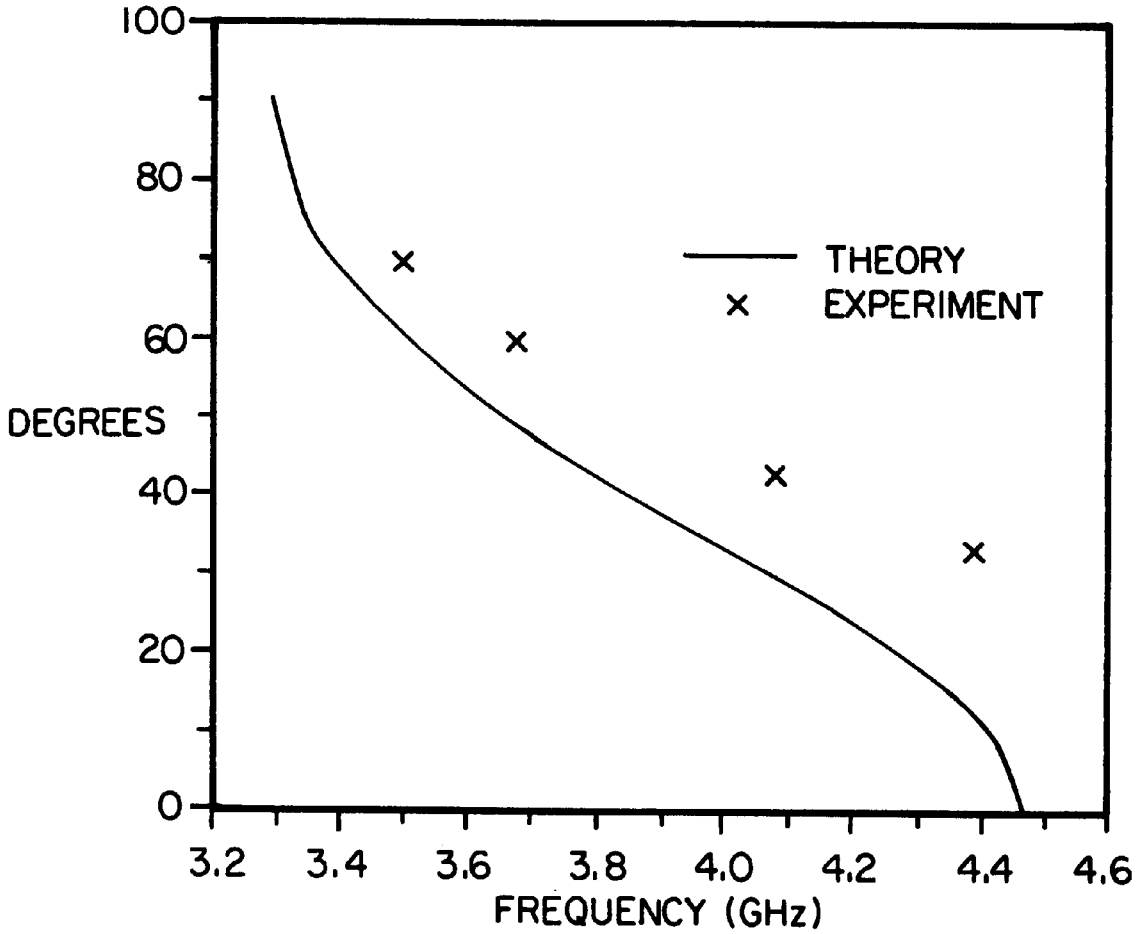
FIG. 5 is a graph illustrating the angle of the main peak from the ground plane as a function of frequency.

FIG. 5 is a graph illustrating the angle of the main peak from the ground plane as a function of frequency for the first embodiment described above. From FIG. 5, it is easily seen that there is relatively good agreement between the theoretical results and the actual experimental results. The experimental results differ slightly at relatively low or grazing angles, where the diffraction effect is strong.

Figure 6A:
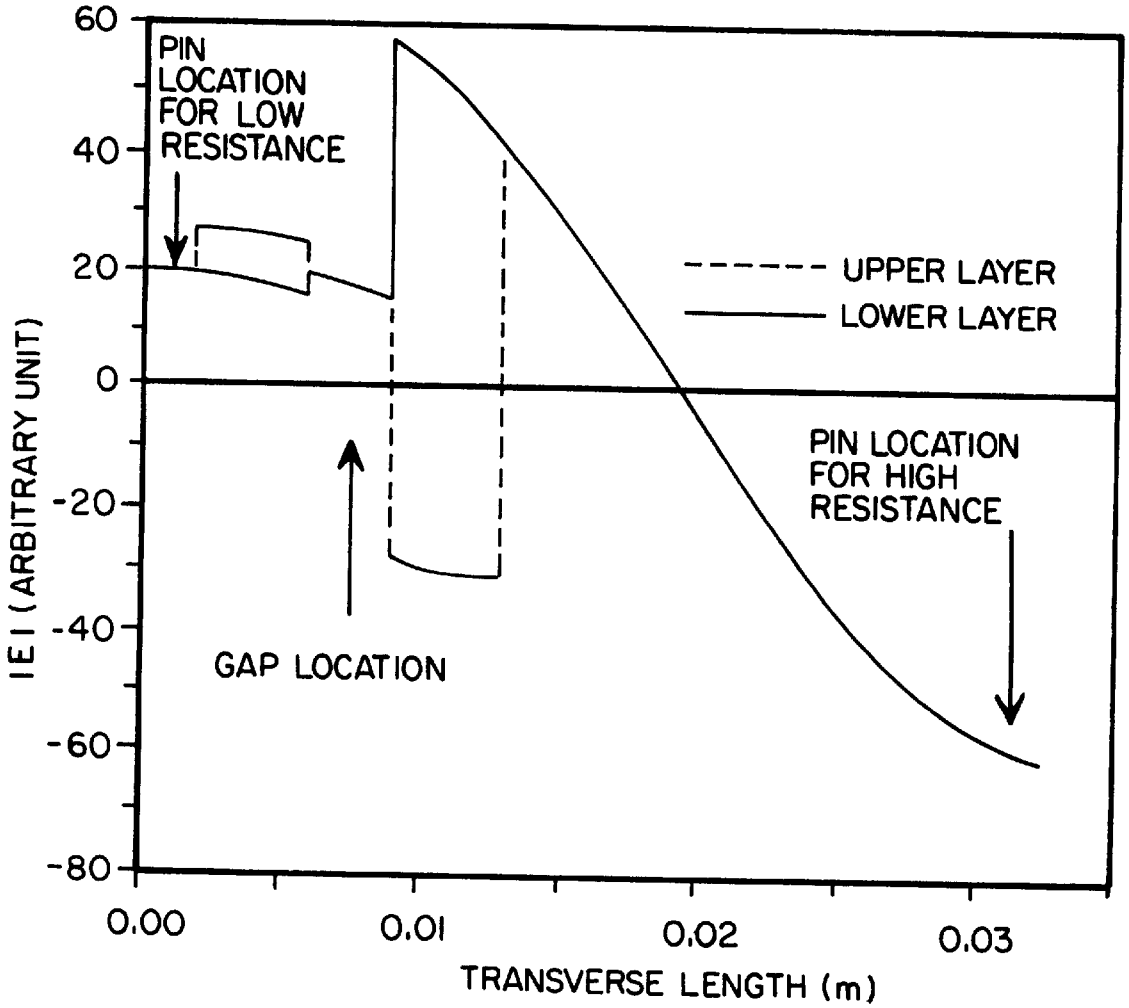
FIG. 6*a* is a graph illustrating the field distribution of the Z component of the electric field as a function of distance in the transverse or X direction.
Figure 6B:
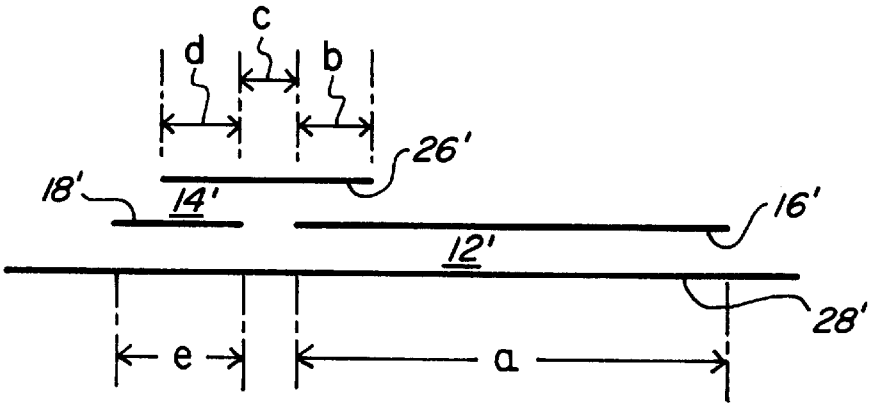
FIG. 6*b* is a schematic drawing illustrating different portions of the leaky-wave microstrip antenna of the present invention.

FIG. 6*a* is a graph illustrating the field variation as a function of distance X in meters for the first embodiment of the present invention. FIG. 6*b* schematically illustrates the layered structure of the first embodiment. Line 18' represents the second patch 18; line 16' represents the first patch 16; space or gap 20' represents the gap 20; line 26' represents the coupling patch 26 and line 28' represents the ground plane 28, all illustrated in FIGS. 1 and 2. Accordingly, the space 12' between lines 18' and 16' and line 28' represents the lower dielectric layer 12 in FIG. 2, and the space 14' between lines 18', 16' and 26' represents the upper dielectric layer 14 in FIG. 2. Letters a, b, c, d, and e represent distances in the X direction of the respective associated surfaces.

The operation of the present invention can readily be appreciated. In a single microstrip line, the dominant mode is "quasi" transverse electromagnetic mode or TEM. However, this is a non-radiating surface mode. The higher order modes, however, become leaky when the propagation constant is less than that of the free space wave number, $K_0$. Therefore, a leaky-wave antenna may be realized by using an elongated microstrip line properly excited by a coaxial probe at the corner of one end. However, the surface-mode excitations need to be suppressed. The present invention, in utilizing a double layer substructure, facilitates variation of impedance to match the impedance at the feed or source, and therefore the suppression of surface mode excitations. The field distribution at the feed location is altered to match the input impedance by varying the locations and widths of metallic patches on the two layers of dielectric material. Once the input impedance is matched to a particular leaky-mode propagation, the surface modes will be likely to be suppressed because of impedance mismatch to all modes other than the intended leaky mode. This makes possible the planar construction of a leaky-wave microstrip antenna.

In theory, the present invention can be analyzed by using the cavity model to analyze the lowest-order leaky mode. The cutoff frequencies are obtained by solving a one dimensional problem assuming no field variation along the longitudinal direction. Assuming the attenuation constant is relatively small, the real part of the propagation constant is approximately given by:

$$\beta = \sqrt{\varepsilon_r k_0^2 - k_x^2}$$

Where $k_0$ is the free space wave number, $k_x$ is the wave vector component in the direction perpendicular to the wave propagation, and $\epsilon_r$ is the dielectric constant of the substrate. From this expression, we can obtain the frequency range within which the mode becomes leaky. When the operating frequency is less than the cutoff frequency, $f_c$, the wave becomes evanescent. On the other hand, when the propagation constant is larger than $k_0$, the mode becomes a surface wave, which propagates without any radiation. Thus, the frequency range for the leaky-wave mode of operation is given by:

$$f_c < f < \frac{f_c\sqrt{\varepsilon_r}}{\sqrt{\varepsilon_r - 1}}$$

It is noted that the bandwidth increases drastically as the dielectric constant becomes close to one. The radiation patterns are obtained from the equivalent magnetic circuits along the edges of the microstrip layers in the longitudinal direction. The main beam direction changes as the frequency shifts, since the propagation constant and the phase variation of the equivalent magnetic circuits depends on the frequency. The angle of the main beam from the ground plane is given by:

$$\theta_m = \cos^{-1}\frac{\beta}{k_0} = \cos^{-1}\sqrt{\varepsilon_r\left[1 - \left(\frac{f_c}{f}\right)^2\right]}$$

From the above theoretical analysis it should be appreciated that, as the relative dielectric constant approaches 1.0 the leaky wave antenna bandwidth becomes much wider. To verify this, a second embodiment of a leaky-wave microstrip antenna according to the present invention was fabricated using ROHACELL 71 HF dielectric material having a dielectric constant of approximately 1.1. Accordingly, the upper frequency range of the second embodiment should be $1.1f_c$ to $3.4f_c$. For the second embodiment, the lower and upper dielectric pieces were 29.5 centimeters long and 2 millimeters thick. A 30×10 centimeter copper plate ground plane was used having a thickness of 0.5 millimeters. The first, second and coupling patches were 28 centimeters long and had a thickness of 1.5 mil or approximately 0.04 millimeters with an adhesive on one side. Additionally, the second embodiment structure had the following dimensions, referring to FIG. 2, width dimension a being 35.2 millimeters; width dimension b being 6 millimeters; width dimension c being 5 millimeters, width dimension d being 6 millimeters, and width dimension e being 9.2 millimeters. Accordingly, in this second embodiment the longitudinal length was substantially greater than the lateral width. The longitudinal length was greater than approximately five times the lateral width. This second embodiment leaky-wave microstrip antenna had a frequency range of 3.2 to 10.2 GHz or 1:3.2 ratio.

It should be readily appreciated that the present invention, matches the input impedance to a particular leaky mode propagation by shifting the gap location, while suppressing the other modes, thereby making possible a wideband leaky-wave microstrip antenna. The planar structure of the microstrip antenna of the present invention, with its relatively wide frequency bandwidth, makes possible the application of the present invention to various geometrical shapes which can be utilized to modify the radiation patterns.

Accordingly, it should be appreciated that various modifications may be made without departing from the spirit and scope of this invention.

What is claimed is:

1. A leaky-wave microstrip antenna comprising:

a first elongated dielectric having a longitudinal length and lateral width;

the longitudinal length, being substantially greater than the lateral width, is at least twice as long as the lateral width;

a first elongated conductive patch placed on a portion of said first elongated dielectric along a substantial portion of the longitudinal length;

a second elongated conductive patch placed on another portion of said first elongated dielectric along a substantial portion of the longitudinal length, said first and second elongated conductive patches positioned to form a longitudinal gap there between;

a second elongated dielectric placed over said first and second conductive patches and the gap;

a third elongated conductive patch placed over the gap, a probe coupled to one end of the longitudinal length of said first elongated dielectric and said first elongated conductive patch;

whereby electromagnetic radiation can propagate along the longitudinal length; and wherein the gap is positioned such that the input impedance of the microstrip leaky-wave antenna is matched to an electromagnetic radiation source resulting in a leaky-wave mode of propagation.

2. A leaky-wave planar microstrip antenna comprising:

a elongated first dielectric material having a longitudinal length and lateral width, the longitudinal length being substantially greater than the lateral width;

a conductive ground plane formed on a first planar surface of said first dielectric;

an elongated first conductive patch placed on a portion of a second planar surface of said first dielectric material and extending along a substantial portion of the longitudinal length, the second planar surface being opposite the first planar surface;

an elongated second conductive patch placed on another portion of said first dielectric material adjacent to said first conductive patch and extending along a substantial portion of the longitudinal length forming a longitudinal gap having a lateral gap width;

an elongated second dielectric placed over a portion of said first and second conductive patches and the lateral gap width;

an elongated coupling third conductive patch placed along the longitudinal length over the lateral gap width; and an input probe coupled to one end of said first dielectric material and said first conductive patch, said probe capable of providing a source of electromagnetic energy whereby the electromagnetic energy is transmitted along the longitudinal length;

wherein said first, second, and third conductive patches are positioned such that an input impedance of the leaky-wave microstrip antenna is matched resulting in a leaky-wave mode of propagation and electromagnetic radiation being radiated with a wide bandwidth.

3. A leaky-wave planar microstrip antenna as in claim 2 wherein:

said first, second, and third conductive patches are made of copper.

4. A leaky-wave planar microstrip antenna as in claim 2 wherein:

said elongated coupling third conductive patch completely covers the lateral gap width.

5. A leaky-wave planar microstrip antenna as in claim 2 wherein:

said first, second, and third elongated conductive patches have a rectangular shape.

6. A leaky-wave planar microstrip antenna as in claim 2 wherein:

said first and second dielectric material have a dielectric constant equal to or less than 2.2, whereby the smaller the dielectric constant the wider the frequency bandwidth.

7. A wideband leaky-wave planar microstrip antenna comprising:

an elongated first dielectric material having a longitudinal length and lateral width, the longitudinal length being at least five times greater than the lateral width, said first dielectric material having a dielectric constant less than or equal to 2.2;

a conductive ground plane formed on a first planar surface of said first dielectric;

an elongated first conductive patch placed on a portion of a second planar surface of said first dielectric material and extending along the longitudinal length, said second planar surface being opposite first planer surface;

an elongated second conductive patch placed on another portion of said first dielectric material adjacent to said first conductive patch and extending along the longitudinal length forming a longitudinal gap having a lateral gap width;

an elongated second dielectric material placed over a portion of said first and second conductive patches and the lateral gap width, said second dielectric material having a dielectric constant less than or equal to 2.2;

an elongated coupling third conductive patch placed along the longitudinal length over the lateral gap width; and an input probe coupled to one end of said first dielectric material and said first conductive patch, said probe capable of providing a source of microwave electromagnetic energy whereby the electromagnetic energy is transmitted along the longitudinal length;

wherein said first, second, and third conductive patches are positioned such that an input impedance of the leaky-wave microstrip antenna is matched resulting in a leaky-wave mode of propagation and electromagnetic radiation being radiated with a wide bandwidth.

8. An ultra wideband leaky-wave planar microstrip antenna as in claim 7 wherein:

the dielectric constant is approximately 1.

* * * * *